US011076742B2

(12) United States Patent
Ugel et al.

(10) Patent No.: US 11,076,742 B2
(45) Date of Patent: Aug. 3, 2021

(54) DISHWASHER AND METHOD OF OPERATING THE DISHWASHER

(71) Applicant: ELECTROLUX APPLIANCES AKTIEBOLAG, Stockholm (SE)

(72) Inventors: Maurizio Ugel, Veneto (IT); Giuseppe Dreossi, Stockholm (SE); Francesco Cavarretta, Pordenone (IT)

(73) Assignee: Electrolux Appliances Aktiebolag

( * ) Notice: Subject to any disclaimer, the term of this patent is extended or adjusted under 35 U.S.C. 154(b) by 495 days.

(21) Appl. No.: 15/320,195

(22) PCT Filed: Jun. 27, 2014

(86) PCT No.: PCT/EP2014/063768
§ 371 (c)(1),
(2) Date: Dec. 19, 2016

(87) PCT Pub. No.: WO2015/197139
PCT Pub. Date: Dec. 30, 2015

(65) Prior Publication Data

US 2017/0119232 A1 May 4, 2017

(51) Int. Cl.
*A47L 15/42* (2006.01)
*A47L 15/00* (2006.01)

(52) U.S. Cl.
CPC ..... *A47L 15/4295* (2013.01); *A47L 15/0047* (2013.01); *A47L 2401/08* (2013.01);
(Continued)

(58) Field of Classification Search
None
See application file for complete search history.

(56) References Cited

U.S. PATENT DOCUMENTS 5,669,983 A * 9/1997 Cooper ..... A47L 15/0031 134/18
2010/0258145 A1* 10/2010 Heissler ..... A47L 15/0034 134/18
(Continued)

FOREIGN PATENT DOCUMENTS

CN 103876696 A 6/2014
DE 10246016 A1 * 4/2004 ..... A47L 15/4295
(Continued)

OTHER PUBLICATIONS

English Machine Translation of DE-10246016-A1.*
(Continued)

*Primary Examiner* — Mikhail Kornakov
*Assistant Examiner* — Pradhuman Parihar
(74) *Attorney, Agent, or Firm* — RatnerPrestia

(57) ABSTRACT

A method for obtaining information about a load of articles to be cleaned in a dishwasher is provided. The method may include stopping a pump from pumping liquid through a spraying system of the dishwasher at a point of time; recording a pressure signal in a sump of the dishwasher from the point of time the pump was stopped; measuring a time period, said time period being measured from the point of time the pump stopped until the pressure signal is essentially stable; and comparing the time period with reference values for obtaining information about the load in the dishwasher. A corresponding dishwasher, computer program, and computer program product may be provided.

23 Claims, 6 Drawing Sheets

(52) U.S. Cl.
CPC ..... *A47L 2401/09* (2013.01); *A47L 2401/12* (2013.01); *A47L 2401/14* (2013.01); *A47L 2401/20* (2013.01); *A47L 2401/32* (2013.01)

(56) References Cited

U.S. PATENT DOCUMENTS

| | | | | |
|---|---|---|---|---|
| 2012/0125369 | A1* | 5/2012 | Pers | A47L 15/0023 134/18 |
| 2013/0008477 | A1* | 1/2013 | Forst | A47L 15/0049 134/57 D |

FOREIGN PATENT DOCUMENTS

| | | | | |
|---|---|---|---|---|
| DE | 10246016 | A1 | 3/2010 | |
| EP | 2160970 | A2 | 4/2004 | |
| EP | 2022384 | A1 * | 2/2009 | A47L 15/4295 |
| EP | 2022384 | A1 | 2/2009 | |
| EP | 2160970 | A2 * | 3/2010 | A47L 15/0021 |
| EP | 2 662 014 | A1 | 11/2013 | |
| EP | 2662014 | A1 * | 11/2013 | A47L 15/0044 |

OTHER PUBLICATIONS

Office Action for Chinese Application No. 201480079226.3 dated Aug. 20, 2018, 15 pages.
International Search Report and Written Opinion for Application No. PCT/EP2014/063768 dated Jun. 27, 2014.
Office Action for Brazilian Application No. BR 112016028157-8 dated Mar. 2, 2020, 4 pages.

* cited by examiner

DISHWASHER AND METHOD OF OPERATING THE DISHWASHER

CROSS-REFERENCE TO RELATED APPLICATIONS

This application is a national stage application filed under 35 U.S.C. § 371 of International Application No. PCT/EP2014/063768 filed Jun. 27, 2014, which application is hereby incorporated by reference in its entirety.

TECHNICAL FIELD

The invention relates to a method of obtaining information about a load of articles in a dishwasher and to a dishwasher, which is adapted to perform such a method.

BACKGROUND

Dishwashers are household appliances for automatically washing a load of articles such as for instance plates, glasses, pans or cutlery. The load usually comprises various pieces made of different materials, such as cutlery for example made of metal, dishes made of ceramic or plastic, pans made of metal or containers made of plastic. In order to perform washing of the articles contained in the household appliance, a detergent is introduced into a detergent container or receptacle before washing commences and water is supplied to the appliance. The detergent may be of different types, such as powder, liquid, gel or tablets. In various applications, it may be desirable to distinguish between different types of detergent used in the household appliance and/or to detect other particles e.g. in order to determine soil characteristics.

High-end dishwashers today are available having many automatic washing cycles. The concept of using automatic washing cycles is based on the possibility for the user to select an appropriate washing cycle relating to temperature, duration and intensity based on information regarding the load in the dishwasher. The user, who is normally aware of the composition and amount of the load chooses thereby manually the right washing cycle.

It has been found that although there are usually a plurality of cleaning cycles, for example 12 to 15 washing cycles, available on dishwashers, the common user normally only uses 2 to 4 of these washing cycles. This may lead to a higher energy consumption and a higher water consumption than necessary and to a cleaning result that is not entirely optimal. It is thus desirable to provide a dishwasher capable of automatically choosing the right washing cycle based on collected information about the load currently arranged within the dishwasher and based on values stored on an accessible database comprising reference and/or experience values.

In the past several attempts were made to provide a dishwasher and a method, which are capable of detecting the amount and the distribution of the load in the dishwasher. The amount and the distribution of the load in the dishwasher affect the cleaning result. It is desirable to adjust the washing cycle to the amount and distribution of the load. A full load may require a more thorough and thus a longer cleaning cycle than half full load. Additionally it may be required to adjust the temperature, amount of water and cleaning intensity depending on the amount of the load.

EP 2 662 014 A1 discloses a way to collect information about the load in the dishwasher by detecting a vibration signal from a vibration sensor during operation of the dishwasher. Thereby a look-up table is first generated by measuring vibration signals with known load amounts and load distributions. The look-up table is then used during further operation of the dishwasher to detect amount of loads and distribution of loads when the dishwasher is in use by comparing current vibration levels with vibration levels of the look-up table.

The above prior art describes a method and a dishwasher, which is configured to perform such a method, whereby the method is simple and efficient and therefore allows to build more economic dishwashers. The method however only allows limited predictability of the load.

In order provide a method for a dishwasher that is capable of automatically or autonomously choose the optimal washing cycle for the dishwasher it is desirable to gain as much information about the load as possible.

SUMMARY

In view of the above it is an object of the present invention to provide a method and a dishwasher, which is capable of performing such a method allowing to improve the cleaning result and to reduce energy consumption.

Advantageously, the dishwasher is configured to gain information regarding the load during an initial heating phase of the dishwasher so that cleaning parameters, such as amount of water, intensity, temperature can be chosen based on the obtained information.

It is disclosed herein a method for obtaining information about a load of articles to be cleaned in a dishwasher, the method comprising the steps of:

- stopping a pump from pumping liquid through a spraying system of the dishwasher at a point of time;
- recording a pressure signal in a sump of the dishwasher from the point of time the pump was stopped;
- measuring a time period, said time period being measured from the point of time the pump stopped until the pressure signal is essentially stable; and
- comparing the time period with reference values for obtaining information about the load in the dishwasher.

The method may optionally comprise, prior to the stopping step, a step of measuring pressure signals according to the above method, when various known loads of articles are present in the dishwasher and storing the different specific values in a database.

Such a method allows predicting the amount of the load in the dishwasher with great accuracy. It allows the dishwasher to autonomously choose the best washing cycle based on the obtained information of the amount present in the dishwasher.

The above pressure signal may be obtained by a pressure sensor device arranged in a sump of the dishwasher. The pressure signal can be obtained during an initial phase of the washing cycle, allowing the dishwasher to adapt the properties of the washing cycle for the remaining duration of the washing cycle.

In another embodiment the method may further comprise the step of measuring a liquid fill level in a sump of the dishwasher after the point of time the pump was stopped and comparing the liquid fill level with reference values for obtaining information regarding the surface of the articles of the load in the dishwasher.

The reference values may be obtained from the accessible database.

The liquid fill level and/or the pressure signal may be measured and recorded, respectively, with a pressure sensor device.

The amount of water that is bound, for example in droplets, by the surface of the articles of the load, is proportional to the surface of the articles and thus it is possible to obtain the surface or at least a parameter relating to the surface of the articles in the load when comparing the current fill level in the sump with known fill levels in the sump for various loads of articles. The current fill level may also be compared with the fill level in the sump of an empty dishwasher. The fill level of an empty dishwasher is generally the maximum fill level since no water is bound by the surface of the articles of the load.

The information relating to the fill level may also be obtained during an initial phase of the washing cycle to ensure that the washing cycle can be adapted accordingly.

In a further embodiment the method may comprise the step of recording a temperature signal in the dishwasher while the pump is operating again, determining a slope of the temperature signal during an initial heating phase of a washing cycle and comparing the slope with reference values for obtaining information about the composition of the articles of the load in the dishwasher.

In an embodiment the temperature signal may be measured in the sump of the dishwasher.

From the slope of a temperature curve it is possible to determine what kind of material is present in the dishwasher. Metallic material such as pans and a lot of cutlery results in a lower slope than plastic material such as Tupperware, etc. The information about the composition may be used to adjust the maximum temperature during the washing cycle and the intensity thus the pump speed of the pump.

The maximal temperature for different materials of the load such as glass, ceramics and plastic differ quite a lot, plastic is less tolerant to high temperatures than ceramic. It is however important to maximize the washing temperature for each load of articles without damaging the articles of the load, since a higher water temperature results in a better cleaning performance.

Additionally, a load full of plastic articles is harder to clean than for example metal and may thus require a longer washing cycle than a load full of metallic articles.

In another embodiment the method may comprise the step of recording a vibration signal in the dishwasher, preferably on an outer side of the dishwasher, while the pump is operating again for determining an amplitude of the vibration signal and comparing the amplitude with reference values for obtaining information about the distribution of the articles of the load in the dishwasher.

In an embodiment the vibration signal may be measured and recorded on an outer side of a washing container of the dishwasher, preferably on an outer side of a top of the washing container.

The vibration signal allows predicting where in the dishwasher the articles are located and if the dishwasher is fully loaded, three quarters loaded, half loaded, etc. The vibration signal is related to the movement of a spray arm and since the movement pattern of the spray arm is known, the location of the articles can be estimated and predicted. The information regarding the load distribution may be obtained during an initial phase of the washing cycle.

Advantageously the temperature signal is compared with the vibration signal for obtaining information about the specific heat capacity or the mass of the articles of the load.

As described above the heat capacity or the mass of the load may be used to adjust the temperature and thus the energy consumption of the washing cycle.

The temperature signal may additionally be compared with the pressure signal for obtaining information about the specific heat capacity or the mass of the articles of the load.

This is an alternative solution to obtain information about the specific heat capacity or the mass of the load and allows verifying and comparing the previously obtained information regarding the specific heat capacity or the mass with this information about the specific heat capacity.

Alternatively the mass of the articles of the load may be determined, since the mass has a higher influence on the consumed energy than the specific heat capacity. So does plastic have a higher specific heat capacity than metal but it is so much lighter than metal and therefore the influence is smaller on the energy consumption for heating the articles.

The mass of the load is calculated by using the information about the specific heat capacity of the articles of the load.

This is advantageous when determining what kind of material is present in the dishwasher.

As the specific energy consumption and the mass of the dishwasher and the specific heat consumption and the mass of the water in the dishwasher is known, it is possible to calculate the mass of the load as the specific heat capacity of the load is now known.

In a preferred embodiment a washing cycle is chosen based on the obtained information about the articles of the load.

The obtained information may thereby be all or only part of the above described obtained information relating to the amount and/or the distribution and/or the surface and/or the composition and/or the distribution and/or the specific heat capacity and/or the mass of the articles of the load.

Disclosed herein is further a dishwasher comprising a washing container for receiving a load of articles to be cleaned, a spraying system comprising a sump and a pump, said spraying system being configured to spray liquid on the load and a processing unit being connected to the pump, said processing unit having access to a database. The dishwasher may further comprise a pressure sensor device arranged within the sump and connected to the processing unit, whereby the processing unit is configured to measure a time period, said time period being measured from a point of time the pump stopped until a pressure signal from the pressure sensor device is essentially stable and to compare the time period with reference values from the database to obtain information about the load in the dishwasher.

The dishwasher allows obtaining information relating to the amount of the load in the dishwasher by using a pressure signal that is obtained from the pressure sensor. Thereby each drop that falls into the sump is generating an amplitude and it takes longer for the signal to become steady or stable the bigger the load in the dishwasher is.

The amount of the load affects duration and amount of water that is needed for an optimal cleaning result and thus for an optimal washing cycle.

In a further embodiment of the dishwasher, the processing unit may further be configured to measure, based on the pressure signal from the pressure sensor device, a liquid fill level in the sump of the dishwasher after the point of time the pump was stopped and to compare the liquid fill level with reference values from the database to obtain information about the surface of the articles of the load in the dishwasher.

The surface size of the load may affect the amount of rinse aid that is used in a final phase of the washing cycle. Alternatively the size of the surface may affect the amount of water that is used during the washing cycle—a comparably small surface of the load does not require the same amount of water as a comparably big surface of the load;—the big surface will require a higher amount of water.

In an embodiment the dishwasher may comprise a temperature sensor device connected to the processing unit and arranged within the washing container, the processing unit being configured to record a temperature signal from the temperature sensor device, to determine a slope of the temperature signal during an initial heating phase of a dish wash-cycle and to compare the slope with reference values of the database to obtain information about the composition of the articles of the load in the dishwasher.

As previously mentioned, the slope allows to determine the composition of the material of the load in the dishwasher. The material affects the maximal temperature of the water during the washing cycle, thus the above information relating to the slope will most likely be obtained as early as possible during the initial heating phase of the washing cycle.

In another embodiment the dishwasher may comprise a vibration sensor device connected to the processing unit, said vibration sensor device being arranged outside the washing container, preferably on an outer side of a top of the washing container, whereby the processing unit is configured to record a vibration signal from the vibration sensor device for determining an amplitude of the vibration signal and to compare the amplitude with reference values of the database to obtain information about the distribution of the articles of the load in the dishwasher.

The distribution of the load may help the processing unit to adjust the intensity of the washing cycle or even to optimally distribute the resources of the pump to make sure that regions with a lot of dishes or articles are sprayed at intensively.

The processing unit may be configured to compare the temperature signal with the vibration signal for obtaining information about the specific heat capacity of the load, alternatively or additionally the processing unit may be configured to compare the temperature signal with the pressure signal for obtaining information about the specific heat capacity of the articles of the load.

The specific heat capacity of the articles of the load may help the processing unit to adjust the temperature of the cleaning liquid and it also may help to adjust the intensity during the washing cycle thus the pump pressure of the pump.

In a preferred embodiment the processing unit is configured to autonomously choose a washing cycle that is best suitable for the articles of the load based on the obtained information about the articles of the load.

The obtained information may thereby be some or all of the above described parameters relating to the mass, the amount, the surface, the specific heat capacity, the composition and or the distribution of the articles of the load in the dishwasher.

A user basically only needs to close the dishwasher and potentially push a button to initiate the washing cycle. The dishwasher or its processing unit, respectively, will then autonomously choose the best suitable washing cycle for the articles of the load in the dishwasher based on the obtained information.

Herein it is also envisaged to provide a computer program comprising computer-executable components for causing a dishwasher to perform at least part of the steps recited above when the computer-executable components are run on a processing unit included in the dishwasher.

The invention further relates to a computer program product comprising a computer readable medium, the computer readable medium having the computer program according to the previous paragraph embodied therein.

All of the above described information relating to the various parameters can be obtained during an initial phase of each washing cycle. It is thus always possible for the processing unit or the controller to adjust the washing cycle after the initial phase. The washing cycle is thus not any longer a fixed and predefined program that needs to be ran from start to end but a continuously evolving cycle based on obtained information during the washing cycle.

Generally, all terms used in the claims are to be interpreted according to their ordinary meaning in the technical field, unless explicitly defined otherwise herein. All references to "a/an/the element, apparatus, device, unit, component, means, step, etc." are to be interpreted openly as referring to at least one instance of the element, apparatus, device, unit, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
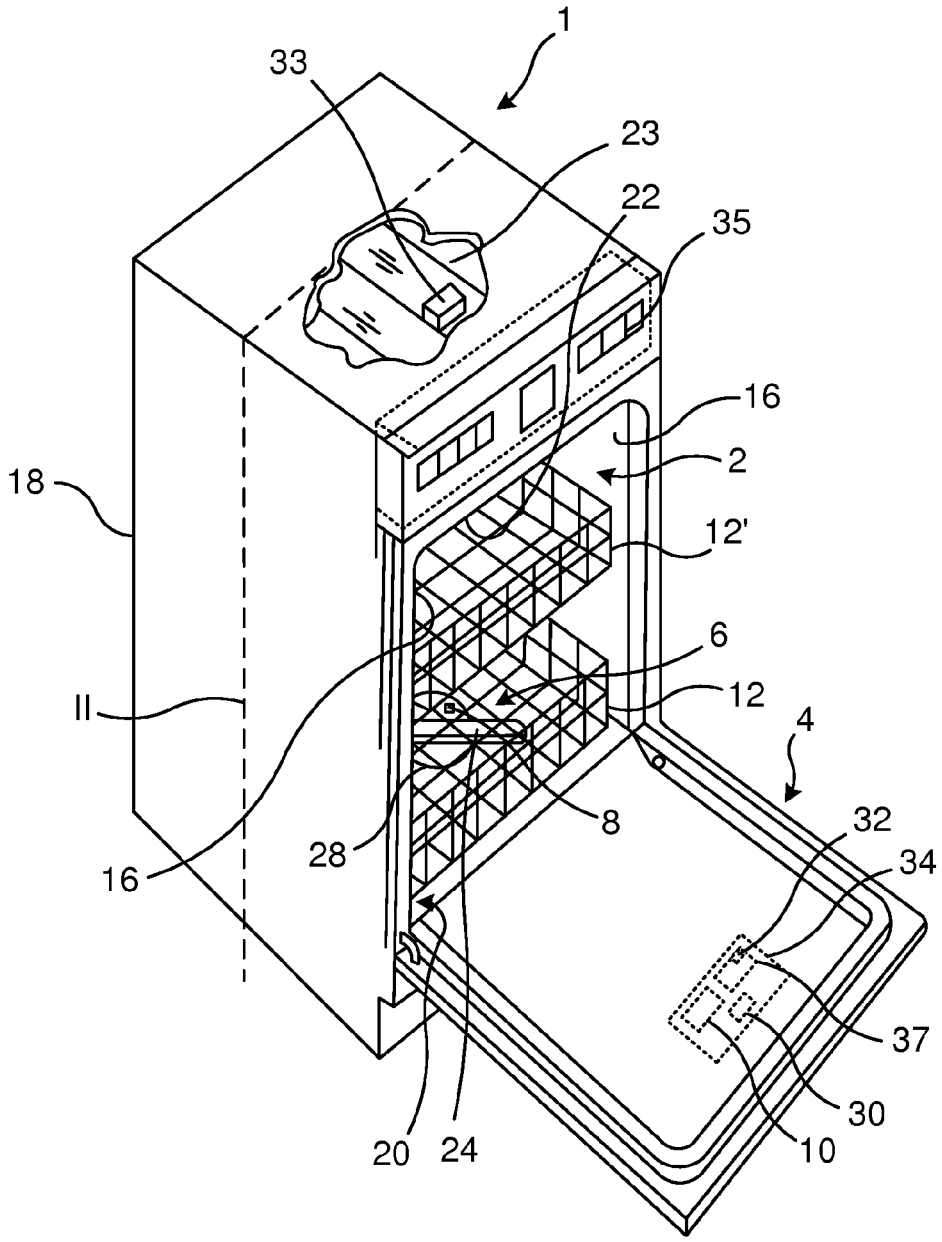
FIG. 1 illustrates schematically a dishwasher according to an embodiment of the invention.

The invention relates to a dishwasher 1 and a method of operating the dishwasher. An example of a dishwasher 1 according to the invention is shown in FIG. 1. The dishwasher 1 comprises a washing container 2, a door 4, a spraying system 6 having at least one spray arm 24, a lower rack 12 and an upper rack 12' and a controller 34. The dishwasher 1 may comprise more than two racks 12, 12' or only one single rack 12. Additionally it may comprise a specific rack for cutlery (not shown). The controller 34 may be embedded in the door 4 and it is communicatively connected to an interface 35. The interface 35 comprises at least one button to start and stop the dishwasher. The door 4 is configured to close the washing container 2 when the dishwasher 1 is switched on to clean a load of articles.

Figure 2:
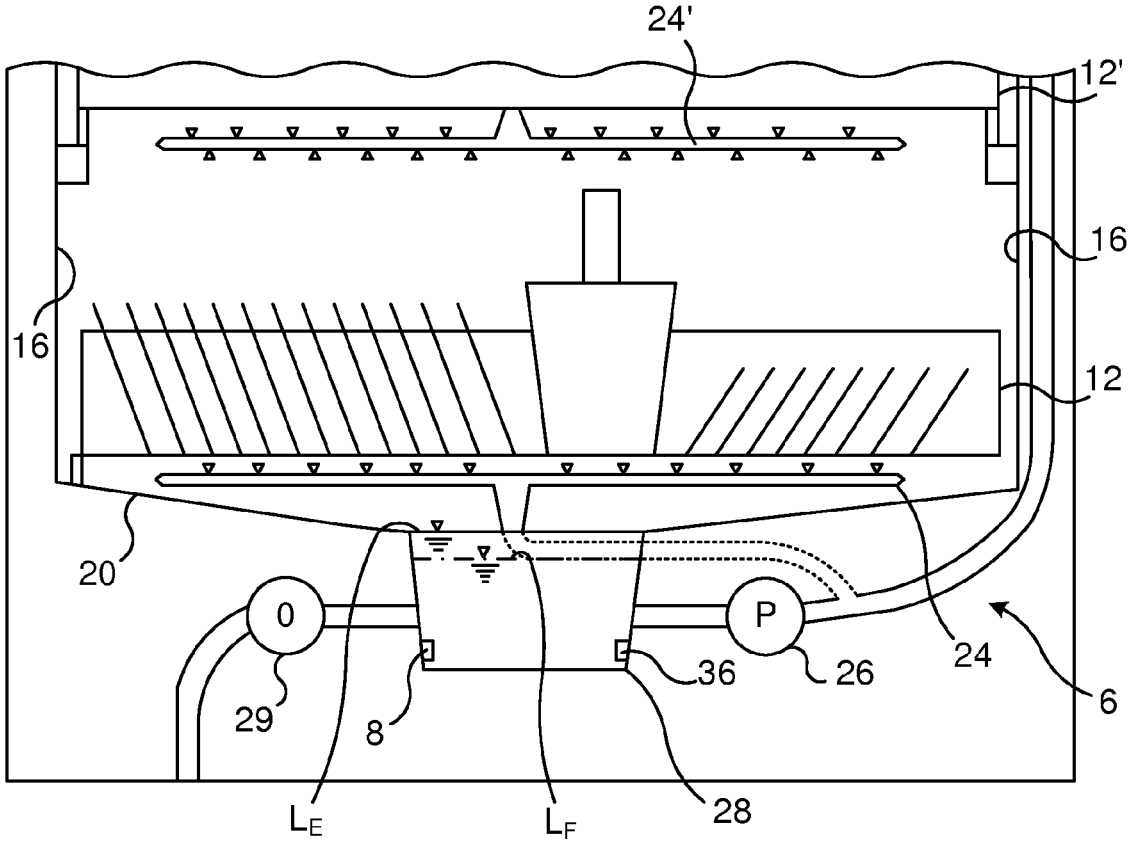
FIG. 2 schematically illustrates a cross-sectional view, the cross section being cut along plane II of FIG. 1, of a base of the dishwasher according to an embodiment of the invention.

The washing container 2 comprises two sidewalls 16, a back wall 18, a bottom 20 and a top 22. On an outer side 23 of the top 22, a vibration sensor device 33 may be arranged. The vibration sensor device 33 is configured to communicate with the controller 34 and to pick up a vibration signal when the dishwasher is operating. The vibration sensor 33 may thereby mainly pick up vibrations resulting from a middle spray arm 24' (c.f. FIG. 2) that is arranged under the upper rack 12' and that sprays at least towards the top 22 of the washing container 2.

It is possible to provide two vibration sensor devices 33, one on the outer side 23 of the top 22, as described, and one on an outer side of the bottom 20 (not illustrated). A middle spray arm 24' (c.f. FIG. 2) is preferably configured to spray cleaning liquid towards the top 22 and the bottom 20. The upper vibration sensor device 33 may thus be able to record or measure a vibration signal that comprises information about the amount, distribution and type of articles in the upper rack 12'. The lower vibration sensor device on the outer side of the bottom 20 (shown in the figures) may be able to record or measure a vibration signal that comprises information about the amount, distribution and type of articles in the lower rack 12. The articles in the lower rack 12 and upper rack 12', respectively, may block the jet of cleaning liquid (low vibration) coming from the middle spray arm 24' (c.f. FIG. 2) or they may allow most of the cleaning liquid to pass without blocking the jet (high vibration). This will be described more in detail when referring to FIGS. 5*a* and 5*b*.

The vibration sensor device 33 is communicatively connected to the controller 34 so that the controller may record and further process the vibration signal. The vibration sensor device 33 may be a piezoelectric shock sensor.

As the vibration sensor device 33 is arranged on the outer side of the washing container 2, the vibration signal is measured on the outer side of the washing container 2, preferably on the outer side 23 of the top 22.

The dishwasher 1 may further comprise a temperature sensor device 8 which is arranged to measure the water temperature in a sump 28 of the spraying system 6 of the dishwasher 1, as best illustrated in FIGS. 1 and 2. The temperature sensor device 8 is communicatively connected to the controller 34 so that the controller may record and further process the temperature signal.

Preferably the temperature signal is measured in the sump 28 and thus the temperature sensor device is preferably arranged within the sump 28 (c.f. FIG. 2).

Alternatively it may be possible to measure the temperature signal anywhere within the spraying system 6.

Referring still to FIG. 1, the controller 34 may comprise a processing unit 10, an electronic storage medium 37 comprising a database 32 or data matrix, and a timer 30. The timer 30, the processing unit 10 and the storage medium 37 may all be communicatively connected with each other.

As illustrated in FIG. 2, which shows a lower part of the dishwasher 1, the spraying system 6 may comprise the at least one spray arm 24, a pump 26 to pump cleaning liquid into the spraying system 6, the sump 28 and several pipes (not indicated in the figures) to transport the cleaning liquid. The spray arm 24 is best illustrated in FIG. 1 and the pump 26 and the sump 28 is best illustrated in FIG. 2. The spray arm 24 is arranged in the washing container 2. The washing container 2 may comprise more than one spray arm 24, for instance one spray arm 24 at the bottom of the washing container 2, one spray arm 24' in the middle of the washing container 2 and one spray arm (not visible) at the top of the washing container 2 to provide an optimal cleaning performance. The pump 26 may be communicatively connected to the controller 34 so that the controller 34 can control the pump 26.

The spraying system 6 may further comprise a drainage pump 29 configured to drain the washing container 2 when necessary. As previously mentioned, the temperature sensor device 8 is arranged with the sump 28 preferably below a drainage outlet leading to the drainage pump 29 and below a hydraulic outlet leading to the pump 26 for driving the cleaning circuit. The temperature sensor device 8 may however be arranged anywhere within the spraying system 6 or the washing container 2.

The spraying system 6 may further comprise a pressure sensor device 36 arranged within the sump 28 and configured to measure a pressure signal during the operation of the dishwasher 1. The pressure sensor device 36 is communicatively connected to the controller 34 so that the controller may record and further process the pressure signal. The pressure sensor device 36 may be a piezoelectric sensor.

As the pressure sensor device 36 is arranged within the sump 28, the pressure sensor signal is measured within the sump 28 inside the dishwasher 1.

FIG. 2 further illustrates the lower rack 12 and partially the upper rack 12'. The lower rack 12 comprises various means to receive articles such as pans, plates, cutlery, etc. The lower spray arm 24 is illustrated and fluidically connected to the pipes of the spraying system 6. The spray arm 24 is rotatably connected to the bottom 20 of the washing container 2 and it starts rotating as soon as hydraulic pressure is present within the lower spray arm 24. The lower spray arm 24 may be connected to the bottom 20 just behind the sump 28, as seen in a direction watching from the door 4. The lower spray arm 24 comprises nozzles on a top side so that cleaning liquid may be sprayed upwards towards the top 22 of the washing container 2.

The middle spray arm 24' is rotatably connected to the upper rack 12' and connected to the pipes of the spraying system 6, at least when the upper rack 12' is entirely shoved into the washing container 2 and when the door 4 is closed. The middle spray arm 24' comprises various nozzles on a top—and bottom side so that cleaning liquid can be sprayed upwards towards the top 22 and downwards towards the bottom 20. The middle spray arm 24' works similarly as the lower spray arm 24 and starts to rotate upon application of hydraulic pressure generated by the pump 26.

The lower rack 12 and the upper rack 12' are configured to roll on wheels when pulled out or pushed in, as illustrated in FIG. 2.

The various sensor devices 8, 33, 36 allow to obtain signals and information regarding various parameters of the dishes or load of articles that is currently present in the washing container 2, as described later herein referring to FIGS. 3*a* to 6. Based on this information it is possible to adapt and optimize a washing cycle of the dishwasher 1.

Figure 3A:
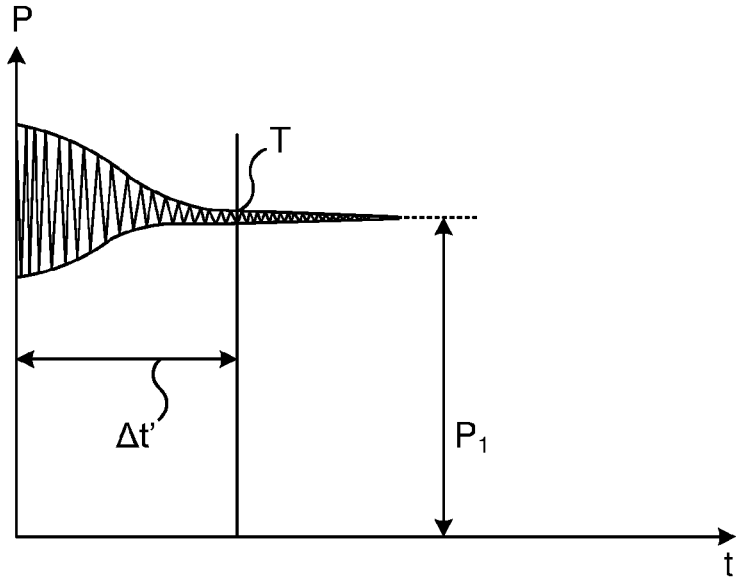
FIG. 3*a* illustrates a pressure signal from a pressure sensor device arranged in the sump of the dishwasher, representing a load of articles.
Figure 3B:
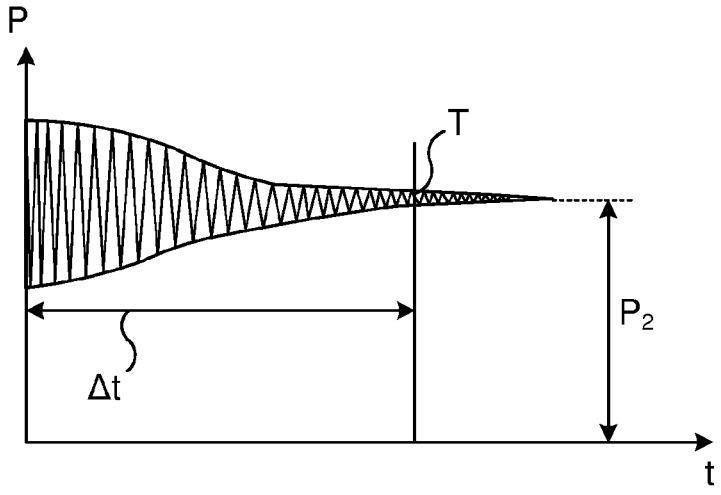
FIG. 3*b* illustrates a similar graph as FIG. 3*a* but for a pressure signal of another load of articles.

Referring now to FIGS. 3*a* and 3*b*, which graphically illustrate a pressure signal that is obtained and recorded after the pump 26 was stopped during an initial phase of a washing cycle. All articles in the washing container 2 have been wetted and each drop of cleaning liquid or water that drops into the sump 28 generates an amplitude of pressure in the sump 28. This amplitude of pressure is recorded by the pressure sensor device 36. When the pressure signal is recorded over time after a point of time when the pump 26 was stopped, a graph as illustrated in FIGS. 3*a* and 3*b* may be obtained. Such a graph or curve allows obtaining information about the articles of the load currently present in the washing container 2.

The longer the drops fall into the sump 28, the more articles the load comprises and the greater the sum of the surfaces of these articles is. The time period Δt until the pressure signal is essentially stable is longer in FIG. 3*b* than in FIG. 3*a*. Based on this measured time period Δt, Δt' the amount of articles in the load may be estimated. FIG. 3*a* illustrates the pressure signal for a load not comprising as many articles as FIG. 3*b* and thus the time period Δt' of FIG. 3*a* is shorter than the time period Δt of FIG. 3*b*. The time period Δt, Δt' may be measured by the timer 30 of the controller 34.

By establishing reference values of various time periods Δt, Δt' for example for a completely empty washing container 2, a completely full washing container 2, a half full washing container 2 etc. in trials during production of the specific model of a dishwasher 1, the controller 34 is capable of gathering information about the amount of articles of the load currently being in the washing container 2. The full, half full etc. is thereby relating to the amount of articles in the washing container 2. A full load results in a different pressure signal than a half full load of articles and an empty washing container 2 results in a comparably short time period Δt, as can be seen in FIGS. 3*a* and 3*b*. The time periods Δt, Δt' are measured from the point of the time the pump 26 was stopped until the amplitude of the pressure signal reaches a threshold value indicated as T in FIGS. 3*a* and 3*b*. The threshold value T may thereby always be the same.

Alternatively it is possible to fixedly define the time period Δt and to measure the amplitude of the pressure signal always after this fixed time period Δt. A higher amplitude may in such a case indicate a fuller load of articles than a low amplitude. In this case the defined time period Δt may for example be 30 s.

From the graphs illustrated in FIGS. 3*a* and 3*b* it is further possible to obtain information relating to a fill level $L_E$, $L_F$ of the sump 28 (c.f. FIG. 2). The essentially stable pressure P1 illustrated in FIG. 3*a* is directly proportional to the fill level $L_E$, $L_F$ of the sump 28. A higher stable pressure P1 indicates that the sump 28 comprises more cleaning liquid or water than a lower stable pressure P2. The pressure P1 may therefore relate to an empty washing container 2, whereby the pressure P2 may relate to a fully loaded or at least half fully loaded washing container 2.

When the pump 26 is switched off or even during operating of the pump 26 the total surface of the articles of the load bounds water or cleaning liquid. The more cleaning liquid or water is bound on the surface the lower the fill level $L_E$, $L_F$ in the sump 28 will be. As the fill level $L_E$ of an empty washing container 2 is known, it can be determined how big the surface of the articles of the load in the washing container 2 is. As an example the sump 28 of an empty washing container 2 usually comprises 4 litres of cleaning liquid whereby the sump 28 of a fully loaded washing container 2 usually comprises only 3.5 to 3.8 litres of cleaning liquid. The difference of volume of cleaning liquid is proportional to the difference of the fill levels $L_E$, $L_F$ and thus to the surface of the articles.

From the above it becomes clear that with a pressure sensor device 36 alone already two independent parameters relating to the articles of the load present in the washing container 2 can be obtained. The two parameters thus the time period Δt, Δt' and the stable pressure P1, P2 and the fill level $L_E$, $L_F$ of the sump 28, respectively, may even be compared to verify the estimation of the load amount and/or surface. The parameters can be obtained during the initial rinsing of the articles of the load, thus very early during a washing cycle.

Figure 4:
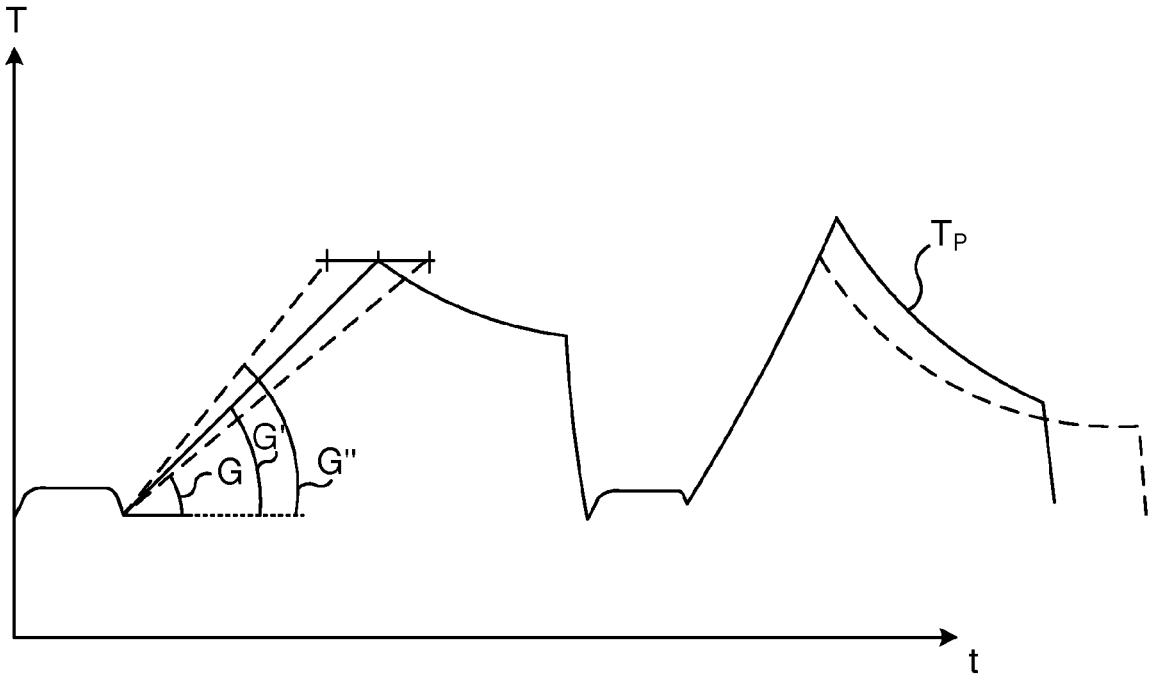
FIG. 4 illustrates a temperature signal of the water temperature during a washing cycle of the dishwasher.

Referring now to FIG. 4, which shows the temperature curve or graph during a complete washing cycle; the temperature of the cleaning liquid or water during an initial heating phase can be measured and recorded. From the graph it is possible to determine the slope G, G', G". The slope G, G', G" give information about the composition of the articles of the load. As one can imagine it takes less time to heat the cleaning liquid when there are no articles in the washing container 2 and thus when the latter is empty;—this will result in a comparably high slope G". When the washing container 2 is half-full, it takes longer to heat the cleaning liquid and the half-full load of articles, since the articles of the half full load need to be heated up as well, resulting in a lower slope G'. When the washing container 2 is fully loaded with articles, the slope G is again lower, as illustrated in FIG. 4, since the full load of articles needs to be heated in addition to the cleaning liquid. Additionally a load of ceramic articles and/or metallic articles absorbs more energy than a load of plastic articles. A load of ceramics or metallic articles has thus a lower slope G than a load of plastic articles. Additionally ceramic absorbs may even absorb more energy than metal, as ceramics are quite heavy and the specific heat capacity is higher as the one of metal.

Recording the temperature signal may thus allow the dishwasher and the controller 34 to adjust the washing cycle after a first period of an initial heating phase. Plastic may need a less high temperature (deformation of articles due to too high temperature) than ceramics or metal and thus the maximal temperature of the washing cycle may be adjusted accordingly. This is indicated with the dashed line at the end of the temperature curve during the drying phase Tp and thus at the end of the washing cycle. For compensating the lower temperature the washing cycle may be longer. Additionally a fully loaded washing container 2 may require more cleaning liquid and thus more water and more cleaning agent.

By establishing the database 32 of slopes comprising reference values relating to various load compositions (plastics, cutlery, pans, ceramics, etc.) it is possible to determine relatively quickly, during an initial heating phase, the composition of the load and additionally the amount of the articles of the load from the temperature curve so that the maximal temperature can still be adjusted before the maximal temperature is actually reached.

From the power consumption during the initial heating phase, the specific heat capacity of the articles of the load may be estimated since the mass and specific heat capacity of the dishwasher and the amount of water or cleaning liquid in it is known.

The controller 34 may further be configured to compare the temperature signal and the pressure signal with each other and extract further information. A pressure signal that indicates a full load and a temperature signal that indicates an empty load may for example refer to a load of plastic articles and/or wooden articles having a high specific heat capacity but a low mass resulting in a comparably low energy absorption when the wooden or plastic articles are heated.

Figure 5A:
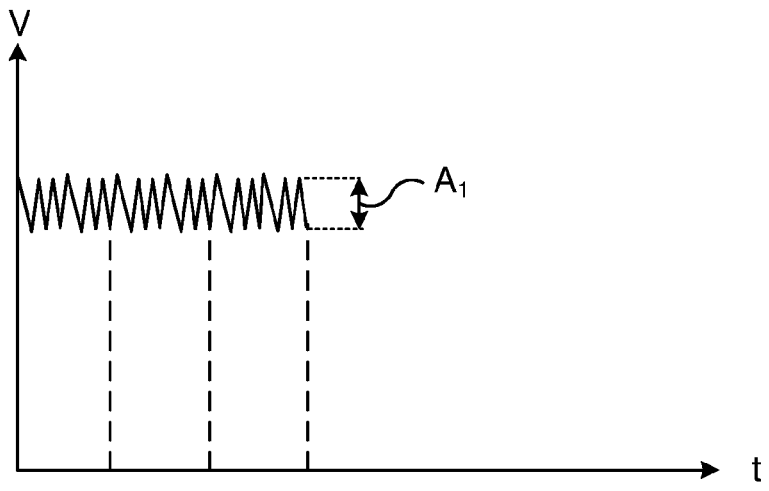
FIG. 5*a* illustrates a vibration signal of a vibration sensor device for a load of articles.
Figure 5B:
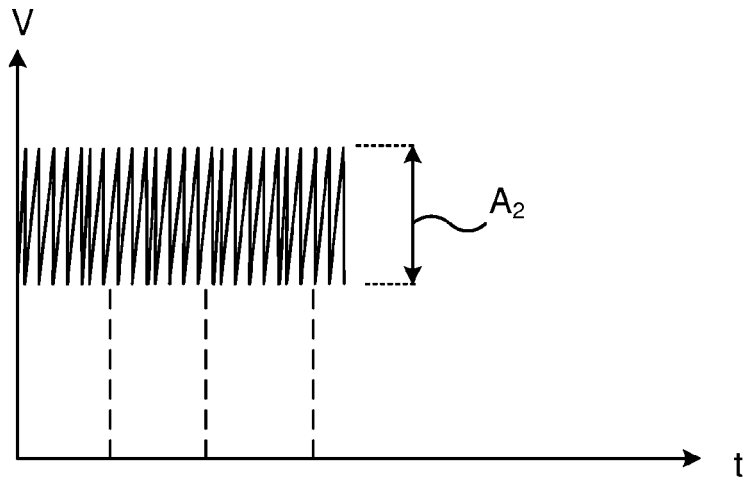
FIG. 5*b* illustrates a similar graph as FIG. 5*a* but for another load of articles.

The vibration sensor device 33 may obtain a vibration signal as illustrated in FIGS. 5*a* and 5*b*. The drops or jets of cleaning liquid coming out of the spray arms 24, 24', specifically the middle spray arm 24' generate a vibration on the top 22 and also at the bottom 20 of the washing container 2. These vibrations have a greater amplitude when the jet is impinging on the top 22 and bottom 20 without hitting another object or article in between. In case the top rack 12' is for example filled with glasses or cups, almost none of the jets are reaching the top 22 without being absorbed or at least partially absorbed by the glasses or cups. Such a case is for example indicated in FIG. 5*a*, where the vibration signal amplitude A1 is comparably low.

A low amplitude A1 of the vibration signal may also be present in case big articles such as serving trays or pans are loaded in the top rack 12'.

In case the upper rack 12' comprises no articles or articles that let the jets at least partially pass such as vertically arranged plates, the amplitude A2 of the vibration signal is higher as indicated in FIG. 5*b*. The vibration signal curve is thereby periodical during a washing cycle, as indicated in FIGS. 5*a* and 5*b*, since the spray arm 24' is rotating and every full rotation should generate at least a similar vibration signal curve sequence.

Again it is possible to establish or produce the database 32 comprising reference values for the vibration amplitude A1, A2 by using known loads of articles or by known distribution of the articles of the load.

The use of the amplitude has been described by a vibration sensor device 33 arranged outside the top 22 of the washing container 2. Such an arrangement may be used to gather information about the load distribution in the top rack 12'. On the other hand an additional vibration sensor may be arranged at the outer side of the bottom, as previously mentioned, to gather information about the distribution of the articles in the bottom rack 12 in a similar manner.

The vibration signal may be compared with the temperature signal.

As an example, when the vibration signal or the amplitude of the vibration signal A1, A2 indicates that the upper rack 12' is fully loaded and the temperature curve and the slope G indicates that the washing container 2 is empty, the controller 34 may conclude that articles of the load have a comparably low specific heat capacity and/or a low mass. Thus the load may comprise a lot of plastic or wooden articles.

Figure 6:
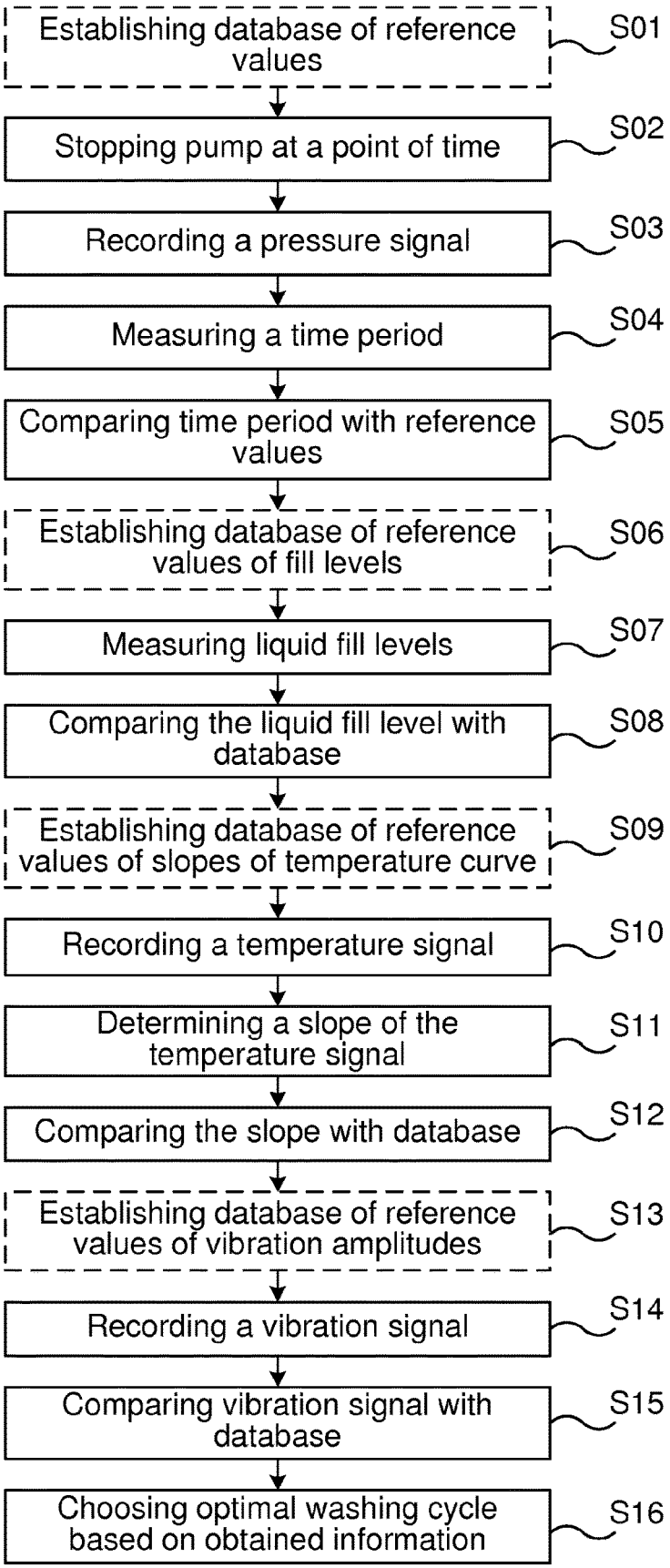
FIG. 6 illustrates a method of obtaining information of a load of articles according to the invention.

Further is herein disclosed a method for obtaining information about a load of articles to be cleaned in a dishwasher, as illustrated in FIG. 6. The method may comprise one or several of the following steps:

- optionally establishing S01 and producing a database 32 of reference values of time periods when known loads of articles are loaded into the dishwasher 1;
- stopping S02 the pump 26 from pumping liquid through a spraying system of the dishwasher 1 at a point of time;
- recording S03 a pressure signal from the point of time the pump 26 was stopped;
- measuring S04 a time period Δt, Δt' said time period being measured from the point of time the pump 26 stopped until the pressure signal is essentially stable; and
- comparing S05 the time period with reference values for obtaining information about the load in the dishwasher 1.

The method may further comprise the step of measuring S07 a liquid fill level $L_E$, $L_F$ in the sump 28 of the dishwasher 1 after the point of time the pump 26 was stopped and comparing S08 the liquid fill level $L_E$, $L_F$ with reference values for fill levels and obtaining information regarding the surface of the articles of the load in the dishwasher 1 based on the detected liquid fill level $L_E$, $L_F$ from the database 32, as illustrated in FIG. 6. The liquid fill level $L_E$, $L_F$ is detected via the pressure sensor device 36 and the pressure signal, respectively. The above steps of measuring S07 and comparing S08 may or may not be performed during the washing cycle. The information relating to the amount of the articles of the load may already be considered sufficient by the controller 34 to adjust and choose the correct washing cycle.

Prior to the step of measuring S07, a step of establishing S06 and producing a database 32 of reference values of different fill levels when known loads of articles are loaded into the dishwasher 1 may be performed.

Still referring to FIG. 6, the method may further comprise the step of recording S10 a temperature signal while the pump is operating again and determining S11 the slope G, G', G" of the temperature signal during an initial heating phase of a washing cycle and comparing S11 the slope with reference values of the database 32 for obtaining information about the composition of the articles of the load in the dishwasher. Again these steps may not be performed if the information about the articles of the load already gathered is considered sufficient to adjust the washing cycle.

Prior to the step of recording S10, a step of establishing S09 and producing a database 32 of reference values of different slopes G, G', G" when known loads of articles are loaded into the dishwasher 1 may be performed.

Further the method may comprise the step of recording S14 a vibration signal while the pump 26 is operating again for determining an amplitude A1, A2 of the vibration signal and comparing S15 the amplitude A1, A2 with reference values of the database 32 for obtaining information about the distribution of the articles of the load in the dishwasher, as shown in FIG. 6. These steps may not be performed if they are not necessary to choose the optimal washing cycle for the detected articles of the load.

Prior to the step of recording S14 a step of establishing S13 and producing a database 32 of reference values of different amplitudes A1, A2 when known loads of articles are loaded into the dishwasher 1 may be performed.

The temperature signal may be compared with the vibration signal for obtaining information about the specific heat capacity and/or the mass of the articles of the load.

Alternatively the temperature signal may be compared with the pressure signal for obtaining information about the specific heat capacity and/or the mass of the articles of the load.

A further step of the method described herein may comprise the choosing S16 of a washing cycle based on the obtained information about the articles of the load, as described above.

The steps described herein may be performed in the specific order or in any other order that is possible and conceivable. Additionally some steps may not be performed if the controller 34 decides to do so based on an algorithm for example.

The information gathered allows optimizing the washing cycle as previously described. It is thereby advantageous to gather as much information about the articles of the load and thus about the load as possible and even to cross check and compare the obtained information, if this is at all possible.

The invention has been described by a dishwasher 1 having a pressure sensor device 36, a temperature sensor device 8 and a vibration sensor device 33. It is however possible to provide a dishwasher 1, which is capable of autonomously choosing the optimal washing cycle, which comprises only two of the mentioned pressure sensor device 36, temperature sensor device 8 or vibration sensor device 33.

The database 32 comprising the different reference values may be a data matrix comprising all the reference values or the databases 32 may be separated whereby each database 32 comprises a specific type of reference values such as the time period Δt, Δt', the fill level $L_E$, $L_F$, the slope G, G', G" or the amplitude A1, A2. The database 32 may be stored on the storage medium 37, as shown in FIG. 1.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A method for obtaining information about a load of articles to be cleaned in a dishwasher, the method comprising:

stopping a pump from pumping liquid through a spraying system of the dishwasher at a point of time;

recording a pressure signal in a sump of the dishwasher from the point of time the pump was stopped until the pressure signal is essentially stable;

measuring a time period, said time period being measured from the point of time the pump stopped until the recorded pressure signal is essentially stable; and comparing the time period with reference values for obtaining information about the load in the dishwasher.

2. The method according to claim 1 further comprising the step of:

recording a temperature signal in the dishwasher while the pump is operating again, determining a slope of the temperature signal during an initial heating phase of a dish wash-cycle and comparing the slope with reference values for obtaining information about the composition of the articles of the load in the dishwasher.

3. The method according to claim 2, further comprising:

recording a vibration signal in the dishwasher while the pump is operating again for determining an amplitude of the vibration signal and comparing the amplitude with reference values for obtaining information about the distribution of the articles of the load in the dishwasher, and comparing the temperature signal with the vibration signal for obtaining information about the specific heat capacity of the articles of the load, wherein the vibration is recorded in the dishwasher while the pump is operating again.

4. The method according to claim 2, wherein the temperature signal is compared with the pressure signal for obtaining information about the specific heat capacity of the articles of the load.

5. The method according to claim 3, wherein the mass of the load is calculated by using the information about the specific heat capacity of the articles of the load.

6. The method according to claim 1, comprising the step of:

recording a vibration signal in the dishwasher while the pump is operating again for determining an amplitude of the vibration signal and comparing the amplitude with reference values for obtaining information about the distribution of the articles of the load in the dishwasher.

7. The method according to claim 6, wherein recording the vibration signal in the dishwasher comprises recording the vibration signal on an outer side of a washing container.

8. The method according to claim 1, wherein the information about the load in the dishwasher comprises information regarding at least one of dishes or cutlery in the dishwasher, and wherein the method further comprises determining the information regarding the at least one of the dishes or the cutlery in the dishwasher based upon the comparison of the time period with the reference values.

9. The method according to claim 8, wherein the information about the load in the dishwasher comprises a surface material of the one or more of the dishes or the cutlery, and wherein the method further comprises determining the surface material of the one or more of the dishes or the cutlery based upon the comparison of the time period with the reference values.

10. The method according to claim 1 further comprising the step of:

measuring a liquid fill level in the sump of the dishwasher after the point of time the pump was stopped and comparing the liquid fill level with reference values for obtaining information regarding the surface of the articles of the load in the dishwasher.

11. The method according to claim 1, wherein a washing cycle is chosen based on the obtained information about the articles of the load.

12. The method according to claim 1, further comprising automatically choosing one or more parameters for the dishwasher including at least one of an amount of water, intensity, and temperature based upon the comparison of the time period with the reference values.

13. The method according to claim 1, wherein the pressure signal is determined to be essentially stable when the pressure signal reaches a threshold stability.

14. A computer program comprising computer-executable components for causing a dishwasher to perform the steps recited in claim 1 when the computer-executable components are run on a processing unit included in the dishwasher.

15. A computer program product comprising a computer readable medium, the computer readable medium having the computer program according to claim 14 embodied therein.

16. A dishwasher comprising:

a washing container for receiving a load of articles to be cleaned;

a spraying system comprising a sump and a pump, said spraying system being configured to spray liquid on the load;

a processing unit being connected to the pump, said processing unit having access to a database;

a pressure sensor device arranged within the sump and connected to the processing unit, at least one non-transitory computer readable storage medium comprising the database and computer-executable components for causing a dishwasher to perform the steps recited in claim 1, wherein the computer-executable components are run on the processing unit included in the dishwasher.

17. The dishwasher according to claim 16 comprising a temperature sensor device connected to the processing unit and arranged within the washing container, the processing unit being configured to record a temperature signal from the temperature sensor device, to determine a slope of the temperature signal during an initial heating phase of a dish wash-cycle and to compare the slope with reference values of the database to obtain information about the composition of the articles of the load in the dishwasher.

18. The dishwasher according to claim 17, further comprising a vibration sensor device connected to the processing unit, said vibration sensor device being arranged outside the washing container, whereby the processing unit is configured to record a vibration signal from the vibration sensor device for determining an amplitude of the vibration signal and to compare the amplitude with reference values of the database to obtain information about the distribution of the articles of the load in the dishwasher.

19. The dishwasher according to claim 18, wherein the processing unit is configured to compare the temperature signal with the vibration signal for obtaining information about the specific heat capacity of the articles of the load.

20. The dishwasher according to claim 18, wherein the vibration sensor device is arranged on an outer side of a top of the washing container.

21. The dishwasher according to claim 17, wherein the processing unit is configured to compare the temperature signal with the pressure signal for obtaining information about the specific heat capacity of the articles of the load.

22. The dishwasher according to claim 16, wherein the processing unit is further configured to measure, based on the pressure signal, a liquid fill level in the sump of the dishwasher after the point of time the pump was stopped and to compare the liquid fill level with reference values from the database to obtain information about the surface of the articles of the load in the dishwasher.

23. The dishwasher according to claim 16, wherein the processing unit is configured to autonomously choose a washing cycle that is best suitable for the articles of the load based on the obtained information about the articles of the load.

* * * * *